US010894996B2

(12) United States Patent
Yokoi et al.

(10) Patent No.: US 10,894,996 B2
(45) **Date of Patent: *Jan. 19, 2021**

(54) HOT ROLLED STEEL SHEET

(71) Applicant: NIPPON STEEL CORPORATION, Tokyo (JP)

(72) Inventors: Tatsuo Yokoi, Tokyo (JP); Nobuo Yoshikawa, Tokyo (JP); Shigeru Yonemura, Tokyo (JP); Kazuya Ootsuka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/499,181

(22) PCT Filed: Mar. 31, 2017

(86) PCT No.: PCT/JP2017/013743
§ 371 (c)(1),
(2) Date: Sep. 27, 2019

(87) PCT Pub. No.: WO2018/179387
PCT Pub. Date: Oct. 4, 2018

(65) Prior Publication Data

US 2020/0024683 A1 Jan. 23, 2020

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/04*** | (2006.01) |
| ***C22C 38/02*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |

(52) U.S. Cl.

CPC ..... *C21D 9/46* (2013.01); *C21D 6/001* (2013.01); *C21D 6/002* (2013.01); *C21D 6/005* (2013.01); *C21D 6/007* (2013.01); *C21D 6/008* (2013.01); *C21D 8/0205* (2013.01); *C21D 8/0247* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/18* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 7,527,700 | B2 * | 5/2009 | Kariya | C22C 38/02 148/320 |
| 2010/0104891 | A1 | 4/2010 | Nakagaito et al. | |
| 2013/0192724 | A1 | 8/2013 | Tanaka et al. | |
| 2014/0255724 | A1 | 9/2014 | Yamanaka et al. | |
| 2017/0183756 | A1 | 6/2017 | Toda et al. | |
| 2018/0044749 | A1 | 2/2018 | Shuto et al. | |
| 2020/0032365 | A1 * | 1/2020 | Yokoi | C22C 38/005 |

FOREIGN PATENT DOCUMENTS

| | | | |
|---|---|---|---|
| CN | 103562427 | A | 2/2014 |
| JP | 10-158735 | A | 6/1998 |
| JP | 2001-152254 | A | 6/2001 |
| JP | 2002-129286 | A | 5/2002 |
| JP | 2003-321738 | A | 11/2003 |
| JP | 2005-256066 | A | 9/2005 |
| JP | 2008-266778 | A | 11/2008 |
| JP | 2009-19265 | A | 1/2009 |
| JP | 2009-84648 | A | 4/2009 |
| JP | 2011-225941 | A | 11/2011 |
| JP | 2012-251201 | A | 12/2012 |

(Continued)

OTHER PUBLICATIONS

International Preliminary Report on Patentability and Written Opinion of the International Searching Authority, dated Oct. 10, 2019, for International Application No. PCT/JP2017/013743 with an English translation of the Written Opinion of the International Searching Authority.

(Continued)

*Primary Examiner* — Jophy S. Koshy

(74) *Attorney, Agent, or Firm* — Birch, Stewart, Kolasch & Birch, LLP

(57) ABSTRACT

A hot rolled steel sheet including a chemical composition consisting of, in mass %, C: 0.07-0.22%, Si: 1.00-3.20%, Mn: 0.80-2.20%, Al: 0.010-1.000%, N≤0.0060%, P≤0.050%, S≤0.005%, Ti: 0-0.150%, Nb: 0-0.100%, V: 0-0.300%, Cu: 0-2.00%, Ni: 0-2.00%, Cr: 0-2.00%, Mo: 0-1.00%, B: 0-0.0100%, Mg: 0-0.0100%, Ca: 0-0.0100%, REM: 0-0.1000%, Zr: 0-1.000%, Co: 0-1.000%, Zn: 0-1.000%, W: 0-1.000%, Sn: 0-0.050%, the balance: Fe and impurities, wherein a metal microstructure includes, in area %, at a position ¼ W or ¾ W from an end face of the steel sheet and ¼ t or ¾ t from a surface, retained austenite: more than 2%-10%, martensite ≤2%, bainite: 10-70%, pearlite ≤2%, the balance: ferrite, an average circle-equivalent diameter of a metallic phase constituted of retained austenite/martensite is 1.0 to 5.0 μm, an average of minimum distances between adjacent metallic phases is 3 μm or more, and a standard deviation of nano hardness is 2.5 GPa or less.

4 Claims, 1 Drawing Sheet

(56) References Cited

FOREIGN PATENT DOCUMENTS

| | | | |
|---|---|---|---|
| JP | 2015-124411 | A | 7/2015 |
| TW | 201319270 | A | 5/2013 |
| TW | 201638358 | A | 11/2016 |
| WO | WO 2011/148490 | A1 | 12/2011 |
| WO | WO 2016/133222 | A1 | 8/2016 |

OTHER PUBLICATIONS

International Search Report, dated Jul. 4, 2017, for International Application No. PCT/JP2017/013743, with an English translation.
Japanese Office Action, dated Oct. 3, 2017, for Japanese Application No. 2017-540285, with an English translation.
Taiwanese Decision to Grant and Search Report, dated Oct. 19, 2017, for Taiwanese Application No. 106111198.

* cited by examiner

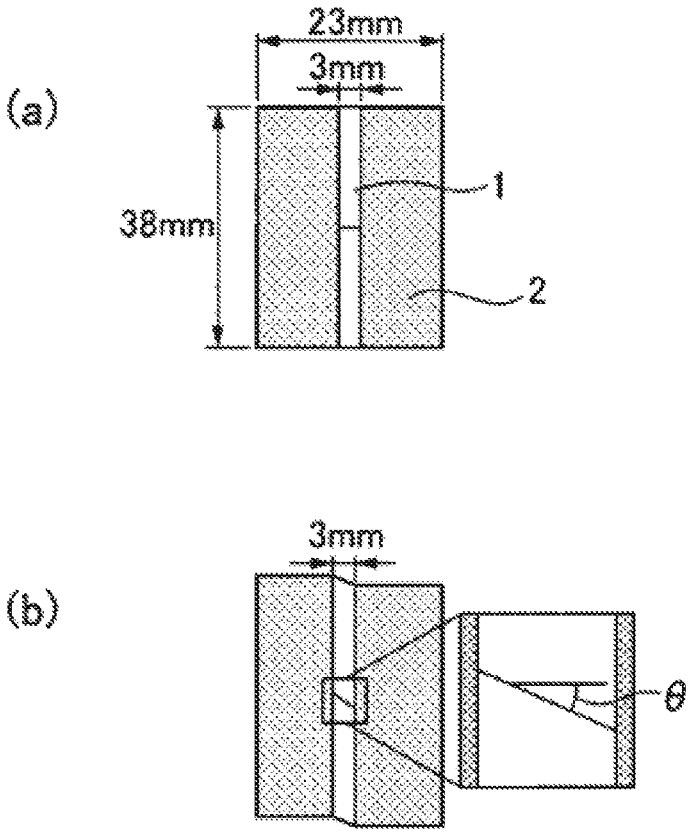
(a)
23mm
3mm
38mm
1
2
(b)
3mm
θ

HOT ROLLED STEEL SHEET

TECHNICAL FIELD

The present invention relates to a hot rolled steel sheet.

BACKGROUND ART

High strength and high press workability are required for steel sheets used in body structures of automobiles in view of safety improvement and weight reduction. In particular, to increase press workability, there is a need for a high-strength steel sheet that ensures both ductility during working and collision resistance after mounted on an automobile.

As such a steel sheet, a strain-induced-transformation type steel sheet that has a mixed structure including retained austenite has been known (for example, see Patent Document 1). In the description hereafter, the strain-induced-transformation type steel sheet may be referred to as a TRIP (Transformation Induced Plasticity) steel sheet.

In addition, to satisfy recent requirements for weight reduction of automobiles and complexity of shapes of parts, there has been proposed a mixed structure steel sheet that has higher elongation and more excellent local ductility than a prior art. For example, Patent Document 2 discloses a steel sheet with a ferrite phase strengthened by causing alloy carbides to precipitate in the ferrite phase during cooling after hot rolling in microstructures consisting of the ferrite phase and a hard second phase (martensite, retained austenite). In the description hereafter, a steel material including soft microstructures such as ferrite and hard microstructures such as martensite, which are dispersed in a balanced manner, such as that in Patent Document 2, may be referred to as a DP (Dupal Phase) steel.

Patent Document 3 discloses a high strength steel sheet excellent in elongation and local ductility, with the use of a mixed structure of precipitation strengthened ferrite and retained austenite, the precipitation distribution being controlled by precipitation phenomena caused primarily by grain boundary dispersion during transformation from austenite to ferrite at an interphase boundary thereof.

Patent Document 4 discloses a strain-induced-transformation type multi-phase steel sheet that has excellent burring workability and a tensile strength of 540 MPa or more. Patent Document 5 discloses a hot rolled TRIP steel with a small variation in material in a coil, that is, a high-workability hot-rolled high-tensile steel sheet that has an excellent material uniformity. Patent Document 6 discloses a steel material in which cracking is inhibited from occurring when an impact load is applied. The steel material further makes it possible to provide a shock absorbing member having a high effective flow stress. Patent Document 7 discloses a DP steel sheet that is a high-strength composite-structured hot-rolled steel sheet that is excellent in stretch flangeability, post-painting corrosion resistance, and a notch fatigue property. Further, Patent Document 8 discloses a high-Young's modulus steel sheet that has excellent hole expandability.

LIST OF PRIOR ART DOCUMENTS

Patent Document

Patent Document 1: JP10-158735A
Patent Document 2: JP2009-84648A

Patent Document 3: JP2011-225941A
Patent Document 4: JP2002-129286A
Patent Document 5: JP2001-152254A
Patent Document 6: JP2015-124411A
Patent Document 7: WO 2016/133222
Patent Document 8: JP2009-19265A

SUMMARY OF INVENTION

Technical Problem

With an increase in complexity of body structures of automobiles as well as complexity of shapes of parts, working on steel sheets for automobiles has been practiced by a mixed combination of new working elements with conventional press working elements, as with the case of sheet metal forging, instead of solely by conventional press working elements. Such conventional press working elements include, for example, deep drawing, hole expansion, bulging, bending, and ironing.

In recent press working typified by sheet metal forging, working elements for forging such as upsetting and thickening have been added to the conventional press working elements by further dispersing a pressing load and applying a partial compressive load. In other words, the sheet metal forging is a way of press working that includes mixed working elements including forging-specific working elements, in addition to conventional working elements for press working steel sheets.

In such sheet metal forging, a steel sheet is deformed into a shaped part with the steel sheet retaining an original sheet thickness or being thinned (reduced in thickness) by the conventional press working, while the sheet thickness is increased in a forged portion by a partially applied compressive force. In this way, efficient deformation can be achieved such that a sheet thickness of the steel sheet intended for a functionally necessary portion can be attained, and strength of the part can be secured.

It has been known that a conventional TRIP steel exhibits good formability during conventional press working. However, it has been found that the sheet metal forging, which is a forming method including forging elements in addition to the conventional press working, may in some cases cause cracks in the steel sheet even at a low working ratio and end in rupture.

Specifically, in the conventional press working, press cracking appears at a point where sheet thickness necking (a reduced sheet thickness of the steel sheet) occurs. It has also been found that even in a working that is not associated with sheet thickness necking, such as sheet metal forging, cracks may be generated in the material, which may end in rupture and products may not be obtained in some cases.

Little is known about what characteristics of steel sheet govern the limit of crack generation in the sheet metal forging and how it can be improved. Accordingly, there has been a need for a TRIP steel that is not prone to rupture even during sheet metal forging while conventional features of a TRIP steel such as deep drawing workability, hole expandability, and bulging workability are still effective.

An object of the present invention, which has been made to solve the above problem, is to provide a hot rolled steel sheet with excellent sheet forgeability, which maintains basic features as a TRIP steel and also makes it possible to improve cracking limit of a forged portion by a partially applied compressive force.

Solution to Problem

The present invention has been made to solve the above problem, and the gist thereof a hot rolled steel sheet, as described below.

(1) A hot rolled steel sheet having a chemical composition consisting of, in mass %, C: 0.07 to 0.22%,
Si: 1.00 to 3.20%,
Mn: 0.80 to 2.20%,
Al: 0.010 to 1.000%,
N: 0.0060% or less,
P: 0.050% or less,
S: 0.005% or less,
Ti: 0 to 0.150%,
Nb: 0 to 0.100%,
V: 0 to 0.300%,
Cu: 0 to 2.00%,
Ni: 0 to 2.00%,
Cr: 0 to 2.00%,
Mo: 0 to 1.00%,
B: 0 to 0.0100%,
Mg: 0 to 0.0100%,
Ca: 0 to 0.0100%,
REM: 0 to 0.1000%,
Zr: 0 to 1.000%,
Co: 0 to 1.000%,
Zn: 0 to 1.000%,
W: 0 to 1.000%,
Sn: 0 to 0.050%, and
the balance: Fe and impurities, wherein when a width and a thickness of the steel sheet in a cross section perpendicular to a rolling direction of the steel sheet are defined as W and t, respectively, a metal microstructure includes, in area %, at a position ¼W or ¾W from an end face of the steel sheet and ¼t or ¾t from a surface of the steel sheet, retained austenite: more than 2% to 10% or less,
martensite: 2% or less,
bainite: 10 to 70%,
pearlite: 2% or less,
the balance: ferrite an average circle-equivalent diameter of a metallic phase constituted of retained austenite and/or martensite is 1.0 to 5.0 μm, an average of minimum distances between adjacent metallic phases is 3 μm or more, and a standard deviation of nano hardness is 2.5 GPa or less.

(2) The hot rolled steel sheet according to the above (1), in which a tensile strength is 780 MPa or more, and
a sheet thickness is 1.0 to 4.0 mm.

Advantageous Effects of Invention

According to the present invention, a hot rolled steel sheet with excellent sheet forgeability, which maintains basic features for a TRIP steel such as deep drawing workability and bulging workability, can be provided.

BRIEF DESCRIPTION OF DRAWINGS

FIG. 1 shows schematic drawings illustrating a simple shear test. FIG. 1(*a*) illustrates a specimen for a simple shear test. FIG. 1(*b*) illustrates a specimen after a simple shear test.

DESCRIPTION OF EMBODIMENTS

The present inventors conducted intensive studies in order to solve the above problem and obtained the following findings.

(a) Equivalent Plastic Strain

The sheet metal forging includes a strain range exceeding a rupture strain in a conventional tensile test (high strain range). Since the sheet metal forging is a composite working, it cannot be evaluated simply based on tensile test and shear test data. Accordingly, the present inventors established a new way of evaluation by introducing an "equivalent plastic strain" as an indicator.

The present inventors have found that the equivalent plastic strain can be used as an indicator to mixedly evaluate a tensile stress and a tensile strain at the time of rupture when a tensile test is conducted and a shearing stress and a shearing strain at the time of rupture when a shear test is conducted.

The equivalent plastic strain is converted using a relation between a shearing stress as and a shear plastic strain εsp in a simple shear test into a relation between a tensile stress a and a tensile strain ε in a uniaxial tensile test, which is different in deformation mode. Assuming an isotropic hardening rule and a plastic work conjugate relationship, a constant, conversion factor (κ) can be used to make a conversion as in the formula below. The conversion factor (κ) is calculated according to a method described later, and then an equivalent plastic strain is derived.

uniaxial tensile test tensile stress $\sigma$=simple shear test shearing stress $\sigma s \times \kappa$ uniaxial tensile test tensile strain $\varepsilon$=simple shear test shear plastic strain $\varepsilon sp/\kappa$ (b) Multi-Stage Shear Test To determine the equivalent plastic strain, it is necessary to obtain a relation between a tensile stress and a tensile strain in a tensile test and a relation between a shearing stress and a shear strain in a shear test. However, the sheet metal forging includes deformation in a high strain range. Accordingly, when test is performed at one time in a commonly used shear test device, cracks may propagate in a specimen from a portion where the specimen is held. As a result, a test of deformation may not often be completed up to the high strain range. Therefore, there is a need for a method for reproducing a working, such as sheet metal forging, in which thinning (thickness reduction and necking) of steel sheet does not occur.

The present inventors have then chosen to divide a shear test into multiple stages, machine an initiation point of a crack in a specimen generated in a portion where the specimen is held in order to prevent the crack from propagating in the specimen after the shear test of each stage, and evaluate a test result obtained by serially connecting the shear test results. Employing the test method, it is possible to obtain the shear test results up to the high strain range and to determine a relation between a shearing stress and a shearing strain up to the high strain range.

On the other hand, a conventional tensile test method can be applied to the tensile stress and the tensile strain. For example, a JIS No. 5 specimen based on JIS Z 2241 (2011) can be used.

(c) Mechanism of Crack Generation

By employing the above-described multi-stage shear test, the evaluation method with an equivalent plastic strain, and micro-structure observations of steel sheet before and after sheet metal forging, the present inventors obtained the following findings about the mechanism of crack generation.

Due to a difference between a hard phase (martensite, retained austenite) and a soft phase (ferrite, bainite), a void (micro cavity) may be generated at an interface between the two phases. Thereafter, as strain associated with the sheet metal forging increases, the void may grow and coalesce with an adjacent void to become a crack, ending in rupture. Accordingly, the crack generation can be inhibited if the void generation can be prevented and if the void can be inhibited from coalescing with an adjacent void even when the void grows. At this time, however, it is also important that intrinsic functionality as a TRIP steel is left unimpaired. In the description hereafter, martensite and retained austenite are collectively referred to as a hard phase. The hard phase fully corresponds to "a metallic phase constituted of retained austenite and/or martensite" described in claims.

The present inventors have found the followings from the findings.

(i) To limit an average diameter of a hard phase.

Specifically, a void may be generated at a boundary between the hard phase and a metallic phase (except the hard phase), and thus limiting an average diameter of the hard phase can lead to a reduction in void generation.

(ii) To reduce variation in nano hardness.

Specifically, the void generation can be reduced by reducing a difference in hardness between a hard phase and a soft phase as much as possible.

(iii) To limit a distance between hard phases.

Specifically, a void may be generated at a boundary between the hard phase and another metallic phase (the soft phase), and thus spacing the hard phases apart from each other can make it difficult for voids to coalesce with each other even when the voids grow.

(iv) Equivalent plastic strain at the time of rupture is 0.50 (50%) or more.

It has been confirmed that when the conditions (i) to (iii) are satisfied, equivalent plastic strain at the time of rupture reaches 0.50 (50%) or more, and a certain level of workability can be secured even in a composite working such as sheet metal forging.

(d) Effective Cumulative Strain

To obtain a microstructure satisfying the above (i) to (iv), in the multi-stand finish rolling, which is conducted by continuous rolling at multiple, three stands or more (for example, 6 or 7 stands) in hot rolling, it is necessary to perform a final finish rolling such that a cumulative strain (hereafter, also referred to as "effective cumulative strain") of rolling at final three stands is 0.10 to 0.40.

The effective cumulative strain is an indicator that takes into consideration grain recovery, recrystallization, and grain growth according to temperature during rolling and rolling reduction of a steel sheet by rolling. Accordingly, a constitutive equation that represents static recovery phenomena in a time lapse after rolling is used for determining the effective cumulative strain. The static recovery of grains in a time lapse after rolling is taken into consideration because energy accumulated as strain in rolled grains may be released in the static recovery due to vanishment of thermal dislocations of grains. Further, the vanishment of thermal dislocations may be affected by rolling temperature and lapsed time after rolling. Accordingly, taking the static recovery into consideration, the present inventors introduced an indicator described, as parameters, by the temperature during rolling, the rolling reduction of a steel sheet by rolling (logarithmic strain), and the lapsed time after rolling, and defined it as "effective cumulative strain".

By limiting the effective cumulative strain in this way, the average circle-equivalent diameter of the hard phase is limited and the distance between adjacent hard phases is limited, leading to reduction in variation in nano hardness. As a result, it is possible to inhibit voids generated at an interface between a hard phase and a soft phase from growing and make it difficult for the voids to coalesce with each other even when the voids grow. In this way, sheet metal forging does not cause cracks, and thus a steel sheet with excellent sheet forgeability can be obtained.

The present invention has been made based on the above-described findings. Description will now be made as to each requirement of the present invention.

(A) Chemical Composition

The reason for limitation on each element is as follows. It is to be noted that a symbol "%" concerning a content in the following description represents "mass %".

C: 0.07 to 0.22%

C (carbon) is an effective element for increasing strength and securing retained austenite. When a content of C is too low, it is not possible to increase the strength sufficiently or to secure the retained austenite. On the other hand, when the content is excessive, the amount (area fraction) of retained austenite increases and rupture strain in sheet metal forging decreases. Accordingly, the content of C is 0.07 to 0.22%. The content of C is preferably 0.08% or more, 0.10% or more, or 0.12% or more, and more preferably 0.14% or more, 0.15% or more, or 0.16% or more. In addition, the content of C is preferably 0.20% or less, or 0.18% or less, and more preferably 0.17% or less.

Si: 1.00 to 3.20%

Si (silicon) has a deoxidation effect, and is an effective element for inhibiting detrimental carbides from being generated and generating ferrite. Si also has an effect of inhibiting decomposition of retained austenite. On the other hand, an excessive content may lead to a decrease in ductility, as well as a decrease in chemical treatability, degrading post-painting corrosion resistance. Accordingly, a content of Si is 1.00 to 3.20%. The content of Si is preferably 1.20% or more, 1.30% or more, or 1.40% or more, and more preferably 1.50% or more, or 1.60% or more. In addition, the content of Si is preferably 3.00% or less, 2.80% or less, or 2.60% or less, and more preferably 2.50% or less, 2.40% or less, or 2.30% or less.

Mn: 0.80 to 2.20%

Mn (manganese) is an effective element for stabilizing retained austenite by expanding austenite zone temperature to a low temperature side and expanding a temperature range of two-phase zone of ferrite and austenite. On the other hand, an excessive content may cause unnecessarily high hardenability, which may prevent ferrite from being secured sufficiently and cause slab cracking during casting. Accordingly, a content of Mn is 0.80 to 2.20%. The content of Mn is preferably 0.90% or more, 1.00% or more, 1.20% or more, or 1.40% or more, and more preferably 1.50% or more. In addition, the content of Mn is preferably 2.00% or less, or 1.90% or less, and more preferably 1.80% or less, or 1.70% or less.

Al: 0.010 to 1.000%

Al (aluminum) has a deoxidation effect and an effect of generating ferrite, as with Si. On the other hand, an excessive content may lead to embrittlement and be likely to cause clogging of a tundish nozzle during casting. Accordingly, a content of Al is 0.010 to 1.000%. The content of Al is preferably 0.015% or more, or 0.020% or more, and more preferably 0.025% or more, or 0.030% or more. In addition, the content of Al is preferably 0.800% or less, 0.700% or less, or 0.600% or less, and more preferably 0.500% or less, or 0.400% or less.

N: 0.0060% or less

N (nitrogen) is an effective element for refining grains by causing AlN or the like to precipitate. On the other hand, an excessive content may lead to not only a decrease in ductility due to remaining dissolved nitrogen, but also a severe cold elongation deterioration. Accordingly, a content of N is 0.0060% or less. It is not particularly necessary to define a lower limit of the content of N, and the lower limit is 0%. The content of N is preferably 0.0050% or less, or 0.0040% or less. In addition, an excessive reduction in the content of N leads to an increase in costs during smelting, and thus the lower limit may be 0.0010%.

P: 0.050% or less

P (phosphorus) is an impurity contained in molten pig iron, and since P may degrade local ductility due to grain boundary segregation and degrade weldability, a content of P is preferably as small as possible. Accordingly, the content of P is limited to 0.050% or less. The content of P is preferably 0.030% or less or 0.020% or less. It is not particularly necessary to define a lower limit, and the lower limit is 0%. However, an excessive reduction in the content of P leads to an increase in costs during smelting, and thus the lower limit may be 0.001%.

S: 0.005% or less

S (sulfur) is also an impurity contained in molten pig iron, and since S may degrade local ductility and weldability due to formation of MnS, a content of S is preferably as small as possible. Accordingly, the content of S is limited to 0.005% or less. To improve ductility and weldability, the content of S may be 0.003% or less or 0.002% or less. It is not particularly necessary to define a lower limit, and the lower limit is 0%. However, an excessive reduction in the content of S leads to an increase in costs during smelting, and thus the lower limit may be 0.0005%.

Ti: 0 to 0.150%

Ti (titanium) has an effect of improving low temperature toughness because carbo-nitride or dissolved Ti may cause a delay in grain growth during hot rolling and thus refine grain diameter in a hot rolled sheet. Further, Ti may be present as TiC, so that it contributes to strengthening of the steel sheet through precipitation strengthening. Accordingly, Ti may be contained as necessary. However, an excessive content may cause saturation of the effect and may be a cause of clogging of a nozzle during casting. Accordingly, a content of Ti is 0.150% or less. An upper limit of Ti may be 0.100%, 0.060%, or 0.020%, as necessary. A lower limit of the content of Ti is 0%. However, the lower limit of the content of Ti may be 0.001% or 0.010% in order to produce the effect of precipitation strengthening sufficiently.

Nb: 0 to 0.100%

Nb (niobium) has an effect of improving low temperature toughness because carbo-nitride or dissolved Nb may cause a delay in grain growth during hot rolling and thus refine grain diameter in a hot rolled sheet. Further, Nb may be present as NbC, so that it contributes to strengthening of the steel sheet through precipitation strengthening. Accordingly, Nb may be contained as necessary. However, an excessive content may cause saturation of the effect, leading to a decrease in economy. Accordingly, a content of Nb is 0.100% or less. A lower limit of Nb is 0%. However, the lower limit may be 0.001% or 0.010% in order to produce the effect sufficiently.

V: 0 to 0.300%

V (vanadium) is an element that has an effect of improving strength of a steel sheet by precipitation strengthening or solid solution strengthening. Accordingly, V may be contained as necessary. However, an excessive content may cause saturation of the effect, leading to a decrease in economy. Accordingly, a content of V is 0.300% or less. The content of V may be 0.200% or less, 0.100% or less, or 0.060% or less, as necessary. A lower limit of Nb is 0%. However, the lower limit may be 0.001% or 0.010% in order to produce the effect sufficiently.

Cu: 0 to 2.00%

Cu (copper) is an element that has an effect of improving strength of a steel sheet by precipitation strengthening or solid solution strengthening. Accordingly, Cu may be contained as necessary. However, an excessive content may cause saturation of the effect, leading to a decrease in economy. Accordingly, a content of Cu is 2.00% or less. Further, a large amount of Cu content may cause a blemish due to a scale on a surface of the steel sheet. Accordingly, the content of Cu may be 1.20% or less, 0.80% or less, 0.50% or less, or 0.25% or less. A lower limit of Cu is 0%. However, the lower limit of Cu may be 0.01% in order to produce the effect sufficiently.

Ni: 0 to 2.00%

Ni (nickel) is an element that has an effect of improving strength of a steel sheet by solid solution strengthening. Accordingly, Ni may be contained as necessary. However, an excessive content may cause saturation of the effect, leading to a decrease in economy. Accordingly, a content of Ni is 2.00% or less. Further, a large amount of Ni content may cause degradation of ductility. Accordingly, the content of Ni may be 0.60% or less, 0.35% or less, or 0.20% or less. A lower limit of Ni is 0%. However, the lower limit of Ni may be 0.01% in order to produce the effect sufficiently.

Cr: 0 to 2.00%

Cr (chromium) is an element that has an effect of improving strength of a steel sheet by solid solution strengthening. Accordingly, Cr may be contained as necessary. However, an excessive content may cause saturation of the effect, leading to a decrease in economy. Accordingly, a content of Cr is 2.00% or less. To improve economy, an upper limit of Cr may be 1.00%, 0.60%, or 0.30%. A lower limit of Cr is 0%. However, the lower limit of Cr may be 0.01% in order to produce the effect sufficiently.

Mo: 0 to 1.00%

Mo (molybdenum) is an element that has an effect of improving strength of a steel sheet by precipitation strengthening or solid solution strengthening. Accordingly, Mo may be contained as necessary. However, an excessive content may cause saturation of the effect, leading to a decrease in economy. Accordingly, a content of Mo is 1.00% or less. To improve economy, an upper limit of Mo may be 0.60%, 0.30%, or 0.10%. A lower limit of Mo is 0%. However, the lower limit of Mo may be 0.005% or 0.01% in order to produce the effect sufficiently.

B: 0 to 0.0100%

B (boron) segregates at a grain boundary, and may increase grain boundary strength to improve low temperature toughness. Accordingly, B may be contained as necessary. However, an excessive content may cause saturation of the effect, leading to a decrease in economy. Accordingly, a content of B is 0.0100% or less. Further, B is a strong quench-hardening element, and a large amount of B content may prevent ferritic transformation from sufficiently progressing during cooling and sufficient retained austenite may not be obtained. Accordingly, a content of B may be 0.0050% or less, 0.0020% or less, or 0.0015%. A lower limit of B is 0%. However, the lower limit of B may be 0.0001% or 0.0002% in order to produce the effect sufficiently.

Mg: 0 to 0.0100%

Mg (magnesium) is an element that controls a morphology of nonmetal inclusions, which may serve as an initiation point of fracture and may be a cause of degradation in workability, to improve the workability. Accordingly, Mg may be contained as necessary. However, an excessive content may cause saturation of the effect, leading to a decrease in economy. Accordingly, a content of Mg is 0.0100% or less. A lower limit of Mg is 0%. However, the lower limit of the content of Mg may be 0.0001% or 0.0005% in order to produce the effect sufficiently.

Ca: 0 to 0.0100%

Ca (calcium) is an element that controls a morphology of nonmetal inclusions, which may serve as an initiation point of fracture and may be a cause of degradation in workability, to improve the workability. Accordingly, Ca may be contained as necessary. However, an excessive content may cause saturation of the effect, leading to a decrease in economy. Accordingly, a content of Ca is 0.0100% or less. A lower limit of Ca is 0%. However, the content of Ca is preferably 0.0005% or more in order to produce the effect sufficiently.

REM: 0 to 0.1000%

REM (rare earth metal) is an element that controls a morphology of nonmetal inclusions, which may serve as an initiation point of fracture and may be a cause of degradation in workability, to improve the workability. Accordingly, REM may be contained as necessary. However, an excessive content may cause saturation of the effect, leading to a decrease in economy. Accordingly, a content of REM is 0.1000% or less. An upper limit of REM may be 0.0100% or 0.0060%, as necessary. A lower limit of REM is 0%. However, the lower limit of the content of REM may be 0.0001% or 0.0005% in order to produce the effect sufficiently.

Here, in the present invention, REM refers to a total of 17 elements of Sc, Y and lanthanoid, and the content of REM means a total content of these elements. It is to be noted that lanthanoid is industrially added in the form of a mischmetal.

Zr: 0 to 1.000%

Co: 0 to 1.000%

Zn: 0 to 1.000%

W: 0 to 1.000%

It has been confirmed that when Zr, Co, Zn, and W are each 1.000% or less, the effect of the present invention is unimpaired even if contained. An upper limit of each of them may be 0.300% or 0.10%. A total content of Zr, Co, Zn, and W is preferably 1.000% or less, or 0.100%. These elements may not necessarily be contained, and a lower limit is 0%, although the lower limit may be 0.0001% as necessary.

Sn: 0 to 0.050%

It has been confirmed that the effect of the present invention is unimpaired if a small amount of Sn (tin) is contained. However, the content of more than 0.05% may be a cause of a flaw during hot rolling. Accordingly, a content of Sn is 0.050% or less. Sn may not necessarily be contained, and a lower limit is 0%, although the lower limit may be 0.001% as necessary.

In the chemical composition of the steel sheet of the present invention, the balance is Fe and impurities.

The "impurity" as used herein refers to a raw material such as ore and scrap and a component contained due to various factors in production processes, and one allowed to the extent that the present invention is not adversely affected.

(B) Metal Microstructure

Description will now be made as to a metal microstructure of a steel sheet of the present invention. It is to be noted that when a width and a thickness of the steel sheet in a cross section perpendicular to a rolling direction of the steel sheet are defined as W and t, respectively, a metal microstructure in the present invention refers to a microstructure that is present at a position ¼W or ¾W from an end face of the steel sheet and ¼t or ¾t from a surface of the steel sheet. Further, a symbol "%" in the following description represents "area %".

Retained austenite: more than 2% to 10% or less

Retained austenite is a microstructure necessary for achieving strain induced transformation (so-called TRIP phenomena). The retained austenite is subjected to martensitic transformation when the steel is worked and remains after the working as martensite, which contributes to secure workability and secure strength of a worked part. To achieve intrinsic functionality of the TRIP steel sheet, the value of the area fraction of the retained austenite is more than 2%.

On the other hand, excessive retained austenite leads to presence of a large amount of martensite, which is a hard phase, due to strain induced transformation. Due to a difference between the hard phase and ferrite, which is a soft phase, a void may be generated at an interface between the two phases, and as strain in the steel sheet due to sheet metal forging increases, voids may coalesce with each other and grow into a crack. Accordingly, an area fraction of the retained austenite is 10% or less. The area fraction of the retained austenite is preferably 2.5% or more, and more preferably 3% or more, or 4% or more. In addition, the area fraction of the retained austenite is preferably 9% or less, and more preferably 8% or less.

Martensite: 2% or Less

A TRIP steel is characterized by workability being secured while retained austenite is transformed into martensite by strain induced transformation during working. Accordingly, the amount of martensite, which is a hard phase, is preferably as small as possible in order to secure workability. Accordingly, an area fraction of martensite is 2% or less. The area fraction of martensite is preferably 1.5% or less, 1% or less, or 0.5% or less. However, it is not particularly necessary to define a lower limit, and the lower limit is 0%.

Bainite: 10 to 70%

Bainite, which is a soft phase, is an important microstructure for balancing strength and elongation, and has an effect of inhibiting crack propagation. In view of this, an area fraction of bainite is 10% or more. To improve strength, a lower limit may be 20%, 30%, 35%, or 40%. On the other hand, an excessive area fraction of bainite leads to a failure of securing retained austenite and thus intrinsic functionality of the TRIP steel sheet, the area fraction is 70% or less. The upper limit may be 65%, 60%, 55%, or 50%, as necessary.

Pearlite: 2% or Less

Presence of a large amount of pearlite reduces strength, and thus an area fraction of pearlite is 2% or less. The upper limit may be 1% or 0.5%, as necessary. It is preferable to reduce the area fraction of pearlite as much as possible and the area fraction is preferably 0%.

Balance: Ferrite

Ferrite, which is a soft phase, is also an important microstructure in view of balancing strength and elongation and improving workability. Accordingly, any microstructure except retained austenite, martensite, bainite, and pearlite is ferrite. It is not particularly necessary to limit an area fraction of ferrite, which is the balance. However, a lower limit of the area fraction may be 10% and an upper limit may be 88%. The lower limit of the area fraction may be 20%, 30%, 35%, or 40% and the upper limit may be 80%, 70%, 60%, or 55%, as necessary.

Here, in the present invention, an area fraction of metal microstructures is determined as follows. A sample is taken at a position ¼W or ¾W from an end face of the steel sheet and ¼t or ¾t from a surface of the steel sheet, as described above. Then, a rolling direction cross section (so-called L-direction cross section) of the sample is observed.

Specifically, the sample is subjected to Nital etching and observed in a 300 μm×300 μm field of view using an optical microscope after the etching. Then, a resultant microstructure photograph is subjected to image analysis to obtain an area fraction A of ferrite, an area fraction B of pearlite, and a total area fraction C of bainite, martensite, and retained austenite.

Next, the portion subjected to Nital etching is subjected to Lepera etching and observed in a 300 μm×300 μm field of view using an optical microscope. Then, a resultant microstructure photograph is subjected to image analysis to calculate a total area fraction D of retained austenite and martensite. Further, a sample subjected to facing up to a depth of ¼ sheet thickness from a normal direction of the sheet surface is used to determine a volume ratio of the retained austenite with X-ray diffraction measurement. Since the volume ratio is substantially equal to the area fraction, the volume ratio is defined as an area fraction E of the retained austenite. An area fraction of bainite is determined from a difference between the area fraction C and the area fraction D, and an area fraction of martensite is determined from a difference between the area fraction E and the area fraction D. In this way, the area fraction of each of ferrite, bainite, martensite, retained austenite, and pearlite can be determined.

In the present invention, a state in which metallic phase consisting of retained austenite and/or martensite (hereafter, also referred to simply as "metallic phase") is present will be defined as follows. It is preferable that the metallic phase (hard phase) is mainly composed of retained austenite, that is, the area fraction of the retained austenite is larger than the area fraction of the martensite.

Average Circle-Equivalent Diameter of Metallic Phase: 1.0 to 5.0 μm

To achieve intrinsic functionality of the TRIP steel sheet, an area of the metallic phase is required to be larger than a certain level. Accordingly, the average circle-equivalent diameter of the metallic phase is 1.0 μm or more. On the other hand, when the metallic phase is excessively large, voids that are present in grain boundary are likely to coalesce with each other, as strain in the steel sheet due to sheet metal forging increases. Accordingly, the average circle-equivalent diameter of the metallic phase is 5.0 μm or less. The average circle-equivalent diameter of the metallic phase is preferably 1.5 μm or more, and more preferably 1.8 μm or more, or 2.0 μm or more. In addition, the average circle-equivalent diameter of the metallic phase is preferably 4.8 μm or less, 4.4 μm or less, or 4.2 μm or less, and more preferably 4 μm or less, 3.5 μm or less, or 3 μm or less.

The average circle-equivalent diameter of the metallic phase is determined as follows. First, in a similar way to measuring the area fraction D, a circle-equivalent diameter is determined from an individual metallic phase area from a microstructure photograph after Lepera etching. Then, a (simple) average of measured circle-equivalent diameters is defined as average circle-equivalent diameter.

Average of Minimum Distances Between Adjacent Metallic Phases: 3 μm or More

To avoid the growth of voids generated at an interface between a hard phase and a soft phase and prevent the voids from coalescing with each other into a larger void, it is necessary to secure a certain amount of distance between hard phases. Accordingly, an average of distances between adjacent metallic phases is 3 μm or more.

In view of preventing crack generation due to void growth, the average is preferably 4 μm or more, and more preferably 5 μm or more. No upper limit is particularly defined. However, to achieve intrinsic functionality of the TRIP steel sheet, the average is preferably 10 μm or less.

The average of minimum distances between adjacent metallic phases is determined as follows. 20 metallic phases are arbitrarily selected, every distances between one of the metallic phases and another one most adjacent to it are calculated, and an average thereof is calculated. The minimum distances between metallic phases is determined by subjecting an image observed in an optical microscope after Lepera etching to image analysis in a similar way to measuring the area fraction D.

(C) Mechanical Properties

Standard Deviation of Nano Hardness: 2.5 GPa or Less

It is possible to inhibit voids from coalescing with each other and growing into a crack by reducing a difference in deformability between a hard phase and a soft phase to reduce voids generated at an interface between the both phases and to create a void spacing. Accordingly, it is possible to inhibit void generation by reducing a nano hardness difference, which corresponds to the difference in deformability between a hard phase and a soft phase. In the present invention, a standard deviation of nano hardness in a sample cross section is employed as an indicator for a hardness difference between a soft phase and a hard phase.

Nano hardness can be measured with the use of, for example, TriboScope/TriboIndenter available from Hysitron. The systems can arbitrarily measure nano hardness at 100 or more points at a load of 1 mN, and calculate a standard deviation of the nano hardness from the results.

To reduce a hardness difference between a soft phase and a hard phase to inhibit void generation, a smaller standard deviation of nano hardness is preferable, and accordingly, it is 2.5 GPa or less. Preferably, the standard deviation may be satisfactory if it is 2.4 GPa or less, or 2.3 GPa or less.

Tensile Strength: 780 MPa or More

The steel sheet according to the present invention preferably has a tensile strength of 780 MPa or more, which is a similar level to a conventional TRIP steel. It is not particularly necessary to define an upper limit to the tensile strength. However, it may be 1200 MPa, 1150 MPa, or 1000 MPa. Here, the tensile strength refers to a tensile strength in JIS Z 2241 (2011).

Product of Uniform Elongation and Tensile Strength: 9500 MPa·% or More

A small uniform elongation is likely to be a cause of sheet thickness reduction due to necking during press forming, and then a cause of press cracking. To secure press formability, it is preferable to satisfy a product of a uniform elongation (u-EL) and a tensile strength (TS): TS×u-EL 9500 MPa %. Here, in a test defined in JIS Z 2241 (2011), the uniform elongation is represented by the following formula:

$$\text{uniform elongation } (u\text{-}EL) = \ln(\varepsilon n0+1)$$

where in a relation between a nominal stress an and a nominal strain εn, εn0 is a nominal strain at a point where a value obtained by differentiating the nominal stress σn with the nominal strain εn is zero.

Equivalent Plastic Strain: 0.50 or More

The equivalent plastic strain is converted using a relation between a shearing stress σs and a shear plastic strain εsp in a simple shear test into a relation between a tensile stress σ and a tensile strain ε in a uniaxial tensile test, which is different in deformation mode, and a constant, conversion factor (κ) is used to make a conversion, assuming an isotropic hardening rule and a plastic work conjugate relationship.

Here, the isotropic hardening rule is a work hardening rule in which it is assumed that the shape of yield curve does not change even when a strain develops (that is, it expands in a similar shape). The plastic work conjugate relationship is a relationship in which work hardening is described only as a function of a plastic work, and exhibits the same amount of work hardening given the same plastic work (σ×ε) regardless of the deformation mode.

A shearing stress and a shear plastic strain in a simple shear test can thereby converted into a tensile stress and a tensile strain in a uniaxial tensile test. The relation is shown below.

uniaxial tensile test tensile stress σ (converted)= simple shear test shearing stress σs×κ uniaxial tensile test tensile strains ε (converted)= simple shear test shear plastic strain εsp/κ

Next, conversion factor κ is determined such that a relation between a shearing stress and a shear plastic strain is similar to a relation between a tensile stress and a tensile strain. For example, the conversion factor κ can be determined in the following procedure. First, a relation between a tensile strain ε (actual value) and a tensile stress σ (actual value) in a uniaxial tensile test is determined. Then, a relation between a shearing strain εs (actual value) and a shearing stress as (actual value) in a uniaxial shear test.

Next, "κ" is changed to determine a tensile strain ε (converted) determined from the shearing strain εs (actual value) and a tensile stress a (converted) determined from the shearing stress σs (actual value). Then, the tensile stress a (converted) when the tensile strain s (converted) is from 0.2% to uniform elongation (u-EL) is determined. At this time, an error between the tensile stress σ (converted) and the tensile stress σ (actual value) is determined, and "κ" that minimizes the error is determined with the method of least squares.

An equivalent plastic strain εeq is defined as a shear plastic strain εsp (rupture) at the time of rupture in a simple shear test converted, with the use of the determined κ, into a tensile strain ε in a simple tensile test.

The steel sheet according to the present invention is characterized by good workability in a high strain domain typified by sheet metal forging, and its equivalent plastic strain εeq satisfies 0.50 or more. Since the equivalent plastic strain of a conventional TRIP steel at best on the order of 0.30, it has been confirmed that the steel sheet according to the present invention has a good sheet forgeability.

(D) Dimension

Sheet Thickness: 1.0 to 4.0 mm

The steel sheet according to the present invention finds application primarily in automobiles and the like and the sheet thickness is ranging primarily from 1.0 to 4.0 mm. Accordingly, the range of sheet thickness may be from 1.0 to 4.0 mm, and, as necessary, a lower limit may be 1.2 mm, 1.4 mm, or 1.6 mm, and an upper limit may be 3.6 mm, 3.2 mm, or 2.8 mm.

(E) Production Method

From studies so far, the present inventors confirmed that the hot rolled steel sheet of the present invention can be produced by the following production processes (a) to (l). Description will now be made as to each of the production processes in detail.

(a) Melting Process

Production methods prior to hot rolling are not particularly limited. In other words, subsequent to melting in a blast furnace or an electric furnace, a variety of second smelting is executed to make an adjustment for a component composition described above. Then, methods such as general continuous casting and thin slab casting may be used to produce a slab. At this time, scrap or the like may be used as raw materials provided that the material can be controlled into the component range of the present invention.

(b) Hot Rolling Process

A produced slab is heated and subjected to hot rolling into a hot rolled steel sheet. There is no particular limit on conditions of hot rolling process. However, heating temperature before hot rolling is preferably 1050 to 1260° C. In the case of continuous casting, the slab may be cooled to a low temperature, and then heated again and hot rolled, or may be heated and hot rolled subsequent to the continuous casting without cooling.

After heating, the slab extracted from a heating furnace is subjected to rough rolling and subsequent multi-stand finish rolling. As described above, the finish rolling is the multi-stand finish rolling conducted by continuous rolling at multiple, three stands or more (for example, 6 or 7 stands). The final finish rolling is executed such that a cumulative strain (effective cumulative strain) of rolling at final three stands is 0.10 to 0.40.

As described above, the effective cumulative strain is an indicator that takes into consideration a grain size variation according to temperature during rolling and rolling reduction of a steel sheet by rolling and a grain size variation when grains statically recover in a time lapse after rolling. The effective cumulative strain (εeff) can be determined in the following formula:

$$\text{effective cumulative strain } (\varepsilon\text{eff})=\Sigma\varepsilon i(ti,Ti) \quad (1)$$

where Σ in the formula (1) represents the sum for i=1 to 3.

i=1, i=2, and i=3 indicate a first stand of rolling from the last in the multi-stand finish rolling (that is, final stand rolling), a second stand of rolling from the last, and a third stand of rolling from the last, respectively.

Here, for each of rolling indicated by i, εi is represented by the following formula:

$$\varepsilon i(ti,Ti)=ei/\exp((ti/\tau R)^{2/3}) \quad (2)$$

where ti: time (s) between i-th stand of rolling from the last and start of primary cooling Ti: rolling temperature (K) of i-th stand of rolling from the last ei: logarithmic strain when rolled at i-th stand of rolling from the last $$ei=|\ln\{1-(i\text{-}th \text{ stand entry side sheet thickness}-i\text{-}th \text{ stand delivery side sheet thickness})/(i\text{-}th \text{ stand entry side sheet thickness})\}|=|\ln\{(i\text{-}th \text{ stand delivery side sheet thickness})/(i\text{-}th \text{ stand entry side sheet thickness})\}| \quad (3)$$

$$\tau R=\tau i0\cdot\exp(Q/(R\cdot Ti)) \quad (4)$$

$$\tau 0=8.46\times10^{-9} \text{ (s)}$$

Q: constant of activation energy regarding movement of dislocations in Fe=183200 (J/mol)

R: gas constant=8.314 (J/(K·mol))

By the definition of the effective cumulative strain thus derived, the average circle-equivalent diameter of the metallic phase mainly composed of retained austenite and the distance between adjacent metallic phases are limited, and variation in nano hardness is reduced. As a result, a steel sheet with excellent sheet forgeability can be obtained, in which the void generation is inhibited at an interface between a hard phase and a soft phase and it is difficult for voids to coalesce with each other even when the voids grow, and thus sheet metal forging does not cause cracks.

An end temperature of the finish rolling, that is, an end temperature of the continuous hot rolling process, may be satisfactory if it is $Ar_3$ (° C.) or more to less than $Ar_3$ (° C.)+30° C. This is because the rolling can be completed in the two-phase zone while the amount of retained austenite is limited. The value of $Ar_3$ can be determined in the following formula:

$$Ar_3=970-325\times C+33\times Si+287\times P+40\times Al-92\times(Mn+Mo+Cu)-46\times(Cr+Ni)$$

where a symbol of an element in the above formula represents a content (in mass %) of the element in the hot rolled steel sheet and is substituted by zero when the element is not contained.

(c) First (Accelerated) Cooling Process

After the finish rolling is completed, cooling of the resultant hot rolled steel sheet is started within 0.5 seconds. Then, the sheet is cooled at an average cooling rate of 10 to 40° C./sec down to a temperature of 650 to 750° C., and thereafter the sheet is air cooled in air for 3 to 10 seconds (air cooling process). In this process and the subsequent cooling in air, ferritic transformation is promoted, and distribution of C necessary for austenite to be retained in the subsequent coiling process is achieved. When the average cooling rate of the first cooling process is less than 10° C./sec, pearlite is likely to be generated. On the other hand, when it is more than 40° C./sec, bainitic transformation at relatively high temperature occurs instead of ferritic transformation, preventing austenite from being retained in the subsequent process.

Further, when the cooling rate in air is more than 8° C./sec or the cooling duration is more than 10 seconds, bainite is likely to be generated and the bainite area fraction increases. On the other hand, when the cooling rate in air is less than 4° C./sec or the cooling duration is less than 3 seconds, pearlite is likely to be generated. It is to be noted that "cooling in air" as used herein means that the steel sheet is air cooled in air at a cooling rate of 4 to 8° C./sec.

(d) Second (Accelerated) Cooling Process

Immediately after the air cooling process, the sheet is cooled at an average cooling rate of 30° C./sec or more down to a temperature of 350 to 450° C. An upper limit of the average cooling rate is not particularly limited. However, it may be 1000° C./sec or less because there is a concern that the steel sheet warps due to thermal strain caused by thermal deviation.

(e) Coiling Process

Thereafter, the cooled hot rolled steel sheet is coiled. Conditions after coiling process are not particularly limited. However, it may be satisfactory if an average cooling rate after coiling down to 200° C. in terms of a coil surface temperature is 30 to 100° C./hour. After the second (accelerated) cooling process, there may be air cooling in air before the coiling process. For the air cooling in air, it is not particularly necessary to limit the cooling rate.

The present invention will now be specifically described with reference to an example, although the present invention is not limited to the example.

Example 1

A steel, which has a chemical composition shown in Table 1, was molten into a slab. The slab was hot rolled, cooled and then coiled under the conditions shown in Table 2 to produce a hot rolled steel sheet. Sheet thicknesses of resultant hot rolled steel sheets are shown in Table 3.

TABLE 1

| Steel | Chemical composition (in mass %, the balance: Fe and impurities) | | | | | | | | | | |
|---|---|---|---|---|---|---|---|---|---|---|---|
| type | C | Si | Mn | Al | N | P | S | Ti | Nb | V | Cu |
| A | 0.193 | 1.54 | 1.51 | 0.050 | 0.003 | 0.008 | 0.003 | — | — | — | — |
| B | 0.101 | 2.06 | 1.97 | 0.040 | 0.003 | 0.010 | 0.003 | 0.016 | — | — | — |
| C | 0.217 | 2.05 | 2.18 | 0.290 | 0.003 | 0.015 | 0.004 | — | — | — | — |
| D | 0.200 | 3.15 | 1.61 | 0.030 | 0.004 | 0.012 | 0.005 | — | — | — | — |
| E | 0.074 | 2.45 | 1.95 | 0.050 | 0.003 | 0.009 | 0.003 | — | 0.012 | — | — |
| F | 0.203 | 2.26 | 0.84 | 0.030 | 0.003 | 0.015 | 0.004 | — | — | 0.050 | — |
| G | 0.211 | 1.04 | 1.93 | 0.140 | 0.004 | 0.012 | 0.005 | — | — | — | 0.20 |
| H | 0.227* | 2.38 | 1.76 | 0.030 | 0.003 | 0.015 | 0.004 | — | — | — | — |
| I | 0.063* | 2.77 | 2.13 | 0.050 | 0.004 | 0.012 | 0.003 | — | — | — | — |
| J | 0.123 | 3.25* | 1.61 | 0.030 | 0.003 | 0.013 | 0.004 | — | — | — | — |
| K | 0.212 | 0.93* | 1.77 | 0.020 | 0.004 | 0.011 | 0.005 | — | — | — | — |
| L | 0.136 | 2.23 | 2.35* | 0.050 | 0.004 | 0.015 | 0.003 | — | — | — | — |
| M | 0.209 | 2.34 | 0.71* | 0.030 | 0.003 | 0.012 | 0.004 | — | — | — | — |
| N | 0.205 | 1.61 | 1.58 | 0.050 | 0.003 | 0.008 | 0.003 | — | — | — | — |
| O | 0.196 | 1.51 | 1.54 | 0.030 | 0.003 | 0.013 | 0.002 | — | — | — | — |
| P | 0.188 | 1.59 | 1.50 | 0.030 | 0.003 | 0.012 | 0.003 | — | — | — | — |
| Q | 0.216 | 1.60 | 1.46 | 0.030 | 0.003 | 0.014 | 0.003 | — | — | — | — |
| R | 0.110 | 2.11 | 1.93 | 0.040 | 0.003 | 0.015 | 0.002 | — | — | — | — |
| S | 0.108 | 2.00 | 2.04 | 0.030 | 0.004 | 0.013 | 0.002 | — | — | — | — |
| T | 0.100 | 2.16 | 2.11 | 0.030 | 0.003 | 0.014 | 0.004 | — | — | — | — |
| U | 0.106 | 2.03 | 2.00 | 0.030 | 0.003 | 0.010 | 0.002 | — | — | — | — |

TABLE 1-continued

| Steel type | Chemical composition (in mass %, the balance: Fe and impurities) Ni | Cr | Mo | B | Mg | Ca | REM | others |
|---|---|---|---|---|---|---|---|---|
| A | — | — | — | — | — | — | — | — |
| B | — | — | — | — | — | — | — | — |
| C | — | — | — | — | — | — | — | — |
| D | — | — | — | — | — | — | — | — |
| E | — | — | — | — | — | — | — | — |
| F | — | — | — | — | — | — | — | — |
| G | — | — | — | — | — | — | — | — |
| H | — | — | — | — | — | — | — | — |
| I | — | — | — | — | — | — | — | — |
| J | — | — | — | — | — | — | — | — |
| K | — | — | — | — | — | — | — | — |
| L | — | — | — | — | — | — | — | — |
| M | — | — | — | — | — | — | — | — |
| N | 0.15 | — | — | — | — | — | — | Zr: 0.02 |
| O | — | 0.25 | — | — | — | — | — | — |
| P | — | — | 0.20 | — | — | — | — | Co: 0.01 |
| Q | — | — | — | 0.0005 | — | — | — | — |
| R | — | — | — | — | — | — | — | Sn: 0.001 |
| S | — | — | — | — | 0.0006 | — | — | — |
| T | — | — | — | — | — | 0.0010 | — | W: 0.04 |
| U | — | — | — | — | — | — | 0.0005 | — |

*indicates out of the definition of the present invention

TABLE 2

| Test No. | Steel type | $Ar_3$ (° C.) | Heating temperature (° C.) | Finish rolling: End temperature (° C.) | Finish rolling: Cumulative strain at final three stands | First cooling: Time before start of cooling (s) | First cooling: Average cooling rate (° C./s) | Air cooling: Start temperature (° C.) | Air cooling: Time (s) | Air cooling: Average cooling rate (° C./s) |
|---|---|---|---|---|---|---|---|---|---|---|
| 1 | A | 823 | 1230 | 840 | 0.372 | 0.33 | 18 | 704 | 6 | 6.0 |
| 2 | A | 823 | 1270 | 850 | 0.348 | 0.33 | 18 | 714 | 6 | 6.0 |
| 3 | A | 823 | 1035 | inapplicable to finish rolling due to rough rolling overload | | | | | | |
| 4 | A | 823 | 1230 | 810 | 0.388 | 0.50 | 12 | 656 | 9 | 6.0 |
| 5 | A | 823 | 1230 | 890 | 0.253 | 0.33 | 25 | 714 | 6 | 6.0 |
| 6 | A | 823 | 1230 | 830 | 0.464 | 0.29 | 19 | 715 | 4 | 6.3 |
| 7 | A | 823 | 1230 | 850 | 0.083 | 0.44 | 27 | 614 | 9 | 4.0 |
| 8 | A | 823 | 1230 | 850 | 0.280 | 0.60 | 11 | 696 | 9 | 6.0 |
| 9 | A | 823 | 1230 | 850 | 0.289 | 0.50 | 9 | 690 | 10 | 6.0 |
| 10 | A | 823 | 1230 | 850 | 0.348 | 0.33 | 14 | 734 | 6 | 6.0 |
| 11 | A | 823 | 1230 | 830 | 0.370 | 0.40 | 28 | 603 | 7 | 5.2 |
| 12 | A | 823 | 1230 | 830 | 0.395 | 0.33 | 18 | 724 | 1 | 6.0 |
| 13 | A | 823 | 1230 | 850 | 0.348 | 0.33 | 18 | 677 | 12 | 6.0 |
| 14 | A | 823 | 1230 | 850 | 0.359 | 0.31 | 19 | 750 | 3 | 3.4 |
| 15 | A | 823 | 1230 | 850 | 0.356 | 0.44 | 24 | 650 | — | — |
| 16 | A | 823 | 1230 | 830 | 0.356 | 0.44 | 24 | 650 | 10 | 6.0 |
| 17 | A | 823 | 1230 | 830 | 0.370 | 0.40 | 15 | 694 | 6 | 6.0 |
| 18 | A | 823 | 1230 | 850 | 0.359 | 0.31 | 19 | 732 | 3 | 6.0 |
| 19 | A | 823 | 1230 | 850 | 0.348 | 0.33 | 18 | 708 | 7 | 6.0 |
| 20 | A | 823 | 1230 | 840 | 0.372 | 0.33 | 18 | 722 | 3 | 6.0 |
| 21 | A | 823 | 1230 | 840 | 0.372 | 0.33 | 18 | 722 | 3 | 6.0 |
| 22 | A | | 1230 | 840 | 0.396 | 0.28 | 210 | 650 | 6 | 6.0 |
| 23 | B | 828 | 1200 | 840 | 0.320 | 0.40 | 15 | 686 | 7 | 7.7 |
| 24 | C | 782 | 1200 | 810 | 0.386 | 0.40 | 15 | 656 | 7 | 7.7 |
| 25 | D | 865 | 1200 | 890 | 0.207 | 0.40 | 21 | 696 | 7 | 7.7 |
| 26 | E | 852 | 1200 | 870 | 0.251 | 0.40 | 18 | 722 | 7 | 4.0 |
| 27 | F | 907 | 1200 | 920 | 0.148 | 0.40 | 25 | 722 | 7 | 4.0 |
| 28 | G | 749 | 1200 | 770 | 0.136 | 0.44 | 13 | 634 | 9 | 4.0 |
| 29 | H* | 818 | 1200 | 840 | 0.305 | 0.44 | 13 | 708 | 8 | 4.0 |
| 30 | I* | 850 | 1200 | 870 | 0.236 | 0.44 | 16 | 718 | 8 | 4.0 |
| 31 | J* | 894 | 1200 | 910 | 0.153 | 0.44 | 22 | 718 | 8 | 4.0 |
| 32 | K* | 773 | 1200 | 800 | 0.395 | 0.44 | 13 | 668 | 8 | 4.0 |
| 33 | L* | 789 | inapplicable to rolling due to slab cracking | | | | | | | |
| 34 | M* | 919 | 1200 | 920 | 0.136 | 0.44 | 23 | 718 | 8 | 4.0 |
| 35 | N | 809 | 1180 | 820 | 0.396 | 0.31 | 19 | 704 | 4 | 4.0 |
| 36 | O | 808 | 1180 | 820 | 0.396 | 0.31 | 19 | 704 | 4 | 4.0 |
| 37 | P | 810 | 1180 | 820 | 0.396 | 0.31 | 19 | 704 | 4 | 4.0 |
| 38 | Q | 823 | 1180 | 840 | 0.354 | 0.31 | 19 | 724 | 4 | 4.0 |
| 39 | R | 832 | 1210 | 850 | 0.332 | 0.31 | 19 | 734 | 4 | 4.0 |
| 40 | S | 818 | 1210 | 840 | 0.354 | 0.31 | 19 | 724 | 4 | 4.0 |

TABLE 2-continued

| | | | | | | | | | | |
|---|---|---|---|---|---|---|---|---|---|---|
| 41 | T | 820 | 1210 | 840 | 0.354 | 0.31 | 19 | 724 | 4 | 4.0 |
| 42 | U | 823 | 1210 | 840 | 0.354 | 0.31 | 19 | 724 | 4 | 4.0 |

| | Second cooling | | | Coiling | |
|---|---|---|---|---|---|
| Test No. | Start temperature (° C.) | Cooling rate (° C./s) | Stop temperature (° C.) | Coiling temperature (° C.) | Average cooling rate down to 200° C. (° C./h) |
| 1 | 704 | 49 | 390 | 390 | 50 |
| 2 | 714 | 55 | 360 | 360 | 50 |
| 3 | inapplicable to finish rolling due to rough rolling overload | | | | |
| 4 | 656 | 32 | 350 | 350 | 40 |
| 5 | 714 | 55 | 360 | 360 | 50 |
| 6 | 715 | 43 | 430 | 430 | 95 |
| 7 | 614 | 35 | 350 | 350 | 60 |
| 8 | 696 | 31 | 360 | 360 | 90 |
| 9 | 690 | 56 | 360 | 360 | 50 |
| 10 | 734 | 52 | 400 | 400 | 90 |
| 11 | 603 | 32 | 350 | 350 | 70 |
| 12 | 724 | 30 | 380 | 380 | 70 |
| 13 | 677 | 804 | 350 | 350 | 40 |
| 14 | 740 | 33 | 400 | 400 | 90 |
| 15 | 650 | 18 | 350 | 350 | 40 |
| 16 | 590 | 36 | 350 | 350 | 40 |
| 17 | 694 | 29 | 440 | 440 | 100 |
| 18 | 732 | 31 | 470 | 470 | 100 |
| 19 | 708 | 66 | 350 | 320 | 30 |
| 20 | 722 | 36 | 380 | 380 | 120 |
| 21 | 722 | 36 | 380 | 380 | 15 |
| 22 | 614 | 31 | 360 | 360 | 50 |
| 23 | 686 | 38 | 390 | 370 | 60 |
| 24 | 656 | 35 | 380 | 370 | 60 |
| 25 | 696 | 37 | 400 | 400 | 80 |
| 26 | 722 | 41 | 400 | 400 | 80 |
| 27 | 722 | 41 | 400 | 400 | 80 |
| 28 | 634 | 38 | 350 | 350 | 50 |
| 29 | 708 | 41 | 360 | 360 | 50 |
| 30 | 718 | 42 | 360 | 360 | 50 |
| 31 | 718 | 42 | 360 | 360 | 50 |
| 32 | 668 | 36 | 360 | 360 | 50 |
| 33 | inapplicable to rolling due to slab cracking | | | | |
| 34 | 718 | 39 | 380 | 380 | 80 |
| 35 | 704 | 37 | 430 | 430 | 95 |
| 36 | 704 | 37 | 430 | 430 | 95 |
| 37 | 704 | 41 | 400 | 400 | 80 |
| 38 | 724 | 43 | 400 | 400 | 80 |
| 39 | 734 | 45 | 400 | 400 | 80 |
| 40 | 724 | 43 | 400 | 400 | 80 |
| 41 | 724 | 43 | 400 | 400 | 80 |
| 42 | 724 | 43 | 400 | 400 | 80 |

*indicates out of the definition of the present invention

TABLE 3

| | | | Metal microstructures | | | | | |
|---|---|---|---|---|---|---|---|---|
| Test No. | Steel type | Sheet thickness (mm) | Pearlite (area %) | Ferrite (area %) | Bainite (area %) | Martensite (area %) | Retained γ (area %) | Metallic phase† average circle-equivalent diameter (μm) |
| 1 | A | 1.6 | 0 | 58 | 33 | 0 | 9 | 3.0 |
| 2 | A | 1.6 | 0 | 30 | 69 | 0 | 1* | 3.0 |
| 3 | A | inapplicable to finish rolling due to rough rolling overload | | | | | | |
| 4 | A | 1.6 | 0 | 18 | 80* | 2 | 0* | 4.0 |
| 5 | A | 1.6 | 0 | 65 | 25 | 0 | 10 | 5.5 |
| 6 | A | 1.5 | 0 | 68 | 21 | 0 | 11* | 3.8 |
| 7 | A | 3.6 | 0 | 19 | 75* | 6* | 0* | 2.5 |
| 8 | A | 1.6 | 0 | 19 | 71* | 10* | 0* | 2.0 |
| 9 | A | 1.6 | 15* | 65 | 20 | 0 | 0* | — |
| 10 | A | 1.6 | 20* | 75 | 5* | 0 | 0* | — |
| 11 | A | 2.1 | 0 | 15 | 80* | 5* | 0* | 2.0 |

TABLE 3-continued

| | | | | | | | | |
|---|---|---|---|---|---|---|---|---|
| 12 | A | 1.6 | 10* | 90 | 0* | 0 | 0* | — |
| 13 | A | 1.6 | 0 | 10 | 85* | 5* | 0* | 2.0 |
| 14 | A | 5.0 | 0 | 78 | 14 | 8* | 0* | 2.2 |
| 15 | A | 1.6 | 0 | 0 | 100 | 0 | 0 | — |
| 16 | A | 1.6 | 0 | 18 | 78* | 4* | 0* | 3.0 |
| 17 | A | 1.6 | 0 | 57 | 26 | 17* | 0* | 1.5 |
| 18 | A | 1.6 | 0 | 59 | 41 | 0 | 0* | — |
| 19 | A | 1.6 | 0 | 60 | 30 | 10* | 0* | 2.0 |
| 20 | A | 1.6 | 0 | 59 | 28 | 13* | 0* | 1.8 |
| 21 | A | 1.6 | 0 | 58 | 42 | 0 | 0* | — |
| 22 | A | 1.6 | 0 | 28 | 68 | 0 | 4 | 0.7* |
| 23 | B | 1.0 | 0 | 43 | 52 | 1 | 4 | 2.2 |
| 24 | C | 1.0 | 0 | 29 | 65 | 2 | 4 | 2.0 |
| 25 | D | 1.0 | 0 | 35 | 60 | 2 | 3 | 1.5 |
| 26 | E | 3.6 | 0 | 59 | 37 | 1 | 3 | 1.2 |
| 27 | F | 3.6 | 0 | 60 | 32 | 0 | 8 | 2.5 |
| 28 | G | 3.6 | 0 | 49 | 44 | 0 | 7 | 2.5 |
| 29 | H* | 3.6 | 0 | 55 | 28 | 0 | 17* | 6.0* |
| 30 | I* | 3.6 | 0 | 86 | 3* | 11* | 0* | 2.0 |
| 31 | J* | 3.6 | 0 | 45 | 50 | 0 | 5 | 2.0 |
| 32 | K* | 3.6 | 0 | 5 | 85* | 10* | 0* | 2.5 |
| 33 | L* | inapplicable to rolling due to slab cracking | | | | | | |
| 34 | M* | 3.6 | 0 | 75 | 20 | 5* | 0* | 2.0 |
| 35 | N | 3.6 | 0 | 60 | 30 | 0 | 10 | 4.2 |
| 36 | O | 3.6 | 0 | 57 | 34 | 0 | 9 | 3.1 |
| 37 | P | 3.6 | 0 | 59 | 32 | 1 | 8 | 2.8 |
| 38 | Q | 3.6 | 0 | 60 | 30 | 1 | 9 | 2.6 |
| 39 | R | 3.6 | 0 | 44 | 50 | 1 | 5 | 2.3 |
| 40 | S | 3.6 | 0 | 40 | 55 | 1 | 4 | 2.0 |
| 41 | T | 3.6 | 0 | 41 | 54 | 1 | 4 | 1.8 |
| 42 | U | 3.6 | 0 | 42 | 53 | 1 | 4 | 1.6 |

| | Metal microstructures | | Mechanical properties | | | |
|---|---|---|---|---|---|---|
| | Metallic phase† average | Nano hardness | | | | |
| Test No. | minimum distance (μm) | standard deviation (GPa) | TS (MPa) | TS × u-EL (MPa · %) | Equivalent plastic strain | |
| 1 | 6 | 2.3 | 811 | 15409 | 0.60 | Inv. Example |
| 2 | 9 | 2.4 | 830 | 12940 | 0.40 | Comparative |
| 3 | inapplicable to finish rolling due to rough rolling overload | | | | | example |
| 4 | 5.0 | 1.3 | 933 | 5598 | 0.90 | |
| 5 | 2* | 2.8* | 870 | 16530 | 0.30 | |
| 6 | 2* | 3.2* | 795 | 16695 | 0.30 | |
| 7 | 8.0 | 1.8 | 890 | 7120 | 0.70 | |
| 8 | 9.0 | 1.7 | 885 | 8850 | 0.40 | |
| 9 | — | 2.6* | 741 | 8151 | 0.40 | |
| 10 | — | 2.6* | 733 | 7330 | 0.40 | |
| 11 | 7.0 | 1.7 | 906 | 9060 | 0.70 | |
| 12 | — | 2.7* | 716 | 9308 | 0.40 | |
| 13 | 6.0 | 1.4 | 855 | 9405 | 0.80 | |
| 14 | 8.5 | 1.9 | 820 | 9840 | 0.40 | |
| 15 | — | 1.2 | 941 | 4705 | 0.40 | |
| 16 | 5.5 | 1.3 | 850 | 9350 | 0.70 | |
| 17 | 2.0 | 2.1 | 832 | 9152 | 0.80 | |
| 18 | — | 1.1 | 820 | 8200 | 0.90 | |
| 19 | 4.0 | 2.6* | 837 | 9207 | 0.40 | |
| 20 | 4.5 | 2.2 | 823 | 9053 | 0.80 | |
| 21 | — | 1.3 | 841 | 9251 | 0.80 | |
| 22 | 1* | 3.0* | 820 | 9020 | 0.20 | |
| 23 | 8 | 2.1 | 832 | 14976 | 0.70 | Inventive |
| 24 | 9 | 2.0 | 1136 | 17040 | 0.60 | example |
| 25 | 10 | 2.0 | 1045 | 16720 | 0.65 | |
| 26 | 9 | 2.0 | 782 | 11730 | 0.55 | |
| 27 | 5 | 2.4 | 803 | 14454 | 0.60 | |
| 28 | 5 | 2.2 | 796 | 14328 | 0.60 | |
| 29 | 2 | 2.7* | 968 | 15488 | 0.30 | Comparative |
| 30 | 7.0 | 2.4 | 754 | 9048 | 0.50 | example |
| 31 | 9 | 2.3 | 978 | 9466 | 0.60 | |
| 32 | 10.0 | 1.8 | 713 | 9269 | 0.80 | |
| 33 | inapplicable to rolling due to slab cracking | | | | | |
| 34 | 6.5 | 2.4 | 761 | 9132 | 0.50 | |
| 35 | 5 | 2.5 | 828 | 16560 | 0.55 | Inventive |
| 36 | 6 | 2.4 | 825 | 15675 | 0.60 | example |
| 37 | 4 | 2.3 | 798 | 16758 | 0.60 | |
| 38 | 4 | 2.4 | 841 | 15979 | 0.65 | |
| 39 | 8 | 2.0 | 861 | 14637 | 0.70 | |

TABLE 3-continued

| | | | | | |
|---|---|---|---|---|---|
| 40 | 9 | 2.0 | 849 | 14433 | 0.70 |
| 41 | 8 | 1.9 | 887 | 14192 | 0.60 |
| 42 | 7 | 1.8 | 845 | 14365 | 0.70 |

*indicates out of the definition of the present invention

†indicates a metallic phase consisting of retained austenite and/or martensite

[Metal Microstructure]

The present inventors observed metal microstructures of the resultant hot rolled steel sheet and measured the area fraction of each of the microstructures. Specifically, when a width and a thickness of the steel sheet in a cross section perpendicular to a rolling direction of the steel sheet are defined as W and t, respectively, a specimen for metal microstructure observation was cut out at a position ¼W from an end face of the steel sheet and ¼t from a surface of the steel sheet.

Then, a rolling direction cross section (so-called L-direction cross section) of the specimen was subjected to Nital etching, and observed in a 300 μm×300 μM field of view using an optical microscope after the etching. Then, a resultant microstructure photograph was subjected to image analysis to determine an area fraction A of ferrite, an area fraction B of pearlite, and a total area fraction C of bainite, martensite, and retained austenite.

Next, the portion subjected to Nital etching was subjected to Lepera etching and observed in a 300 μm×300 μm field of view using an optical microscope. Then, a resultant microstructure photograph was subjected to image analysis to calculate a total area fraction D of retained austenite and martensite. Further, a sample subjected to facing up to a depth of ¼ sheet thickness from a normal direction of the sheet surface was used to determine a volume ratio of the retained austenite with X-ray diffraction measurement. Since the volume ratio is substantially equal to the area fraction, the volume ratio was defined as an area fraction E of the retained austenite. An area fraction of bainite was determined from a difference between the area fraction C and the area fraction D, and an area fraction of martensite was determined from a difference between the area fraction E and the area fraction D. In this way, the area fraction of each of ferrite, bainite, martensite, retained austenite, and pearlite was determined.

Further, the number of metallic phases and the metallic phase area were determined from a microstructure photograph after Lepera etching as described above, circle-equivalent diameters were determined, and the circle-equivalent diameters were averaged to determine an average circle-equivalent diameter. Similarly, from the microstructure photograph after Lepera etching, 20 metallic phases were arbitrarily selected, every distance between one of the metallic phases and another one most adjacent to it was measured, and an average thereof was calculated.

[Mechanical Properties]

Among mechanical properties, tensile strength properties (tensile strength (TS), and uniform elongation (u-EL)) were evaluated in conformity with JIS Z 2241 (2011) using a JIS Z 2241 (2011) No. 5 specimen, which was taken at a position ¼ W or ¾ W from one end of the sheet in a sheet width direction when a sheet width is defined as W with a direction (width direction) perpendicular to a rolling direction being a longitudinal direction.

Further, the present inventors conducted a simple shear test in a procedure described below, and determined the equivalent plastic strain based on the results.

A specimen for the simple shear test is taken at a position ¼ W or ¾ W from one end of the sheet in a sheet width direction when a sheet width is defined as W with a direction (width direction) perpendicular to a rolling direction being a longitudinal direction. FIG. 1(*a*) illustrates an example of the specimen. The specimen for the simple shear test illustrated in FIG. 1(*a*) was processed into a rectangular specimen of 23 mm in the width direction of the steel sheet and 38 mm in the rolling direction of the steel sheet in such a way that both sides were uniformly polished to a sheet thickness of 2.0 mm for uniform sheet thickness.

Chucks were applied to opposite chucking portions 2 on long sides (rolling direction) of the specimen, each chucking portion having 10 mm along a short side direction (width direction), so that a shear width (shear deformation generation portion 1) of 3 mm is provided in the center of the specimen. In the case in which the sheet thickness is less than 2.0 mm, the test was conducted with the sheet thickness being left intact without polishing. Further, the center of the specimen was marked with a straight line in the short side direction (width direction) with a pen or the like.

Then, the chucked long sides were moved in opposite directions along the long side direction (rolling direction) so that the specimen was subjected to shear deformation by loading the specimen with a shearing stress σs. FIG. 1(*b*) illustrates an example of the specimen subjected to shear deformation. The shearing stress σs is a nominal stress as determined in the following formula:

$$\text{shearing stress } \sigma s = \text{shear force}/(\text{length of specimen in rolling direction of steel sheet} \times \text{sheet thickness of specimen})$$

Since the length and the sheet thickness are invariable in the shear test, it can be considered that the shear nominal stress is nearly equal to the shear true stress. During the shear test, a CCD camera was used to capture the straight line drawn in the center of the specimen and the inclination θ of the line was measured (see FIG. 1(*b*)). From the inclination θ, a shear strain εs, which was generated due to the shear deformation, was determined using the following formula:

$$\text{shear strain } \varepsilon s = \tan(\theta)$$

For the simple shear test, a simple shear tester (maximum displacement 8 mm) was used. Accordingly, there is a limitation to the stroke (displacement) of the tester. Further, since cracks may be generated on an end or a chucked portion of the specimen, only one shear test may not complete the test until the specimen ruptures in some cases. As such, a "multi-stage shear test" method, in which a series of operations including application of a shear test load, removal of the load, cutting of an end of a chucked portion of the specimen in a straight line, and reapplication of a load were repeated, was applied as described above.

To evaluate a one continuous simple shear test result by connecting results of these multi-stage shear test in series, a shear plastic strain (εsp) was determined as follows by subtracting an elastic shear strain (εse) taking an elastic shear modulus into consideration from a shear strain (εs)

obtained in each stage of the shear test, such that the shear plastic strains (εs) in every stages were connected into one:

shear plastic strain $\varepsilon sp$=shear strain $\varepsilon s$−elastic shear strain $\varepsilon se$ elastic shear strain $\varepsilon se=\sigma s/G$ where σs: shearing stress G: elastic shear modulus Here, G=E/2(1+ν) was nearly equal to 78000 (MPa).

E (Young's modulus (modulus of longitudinal elasticity)) =206000 (MPa) Poisson's ratio (ν)=0.3

The simple shear test was conducted until the specimen ruptures. In this way, it is possible to trace a relation between the shearing stress σs and the shear plastic strain εsp. Then, a shear plastic strain when the specimen ruptures is εspf.

From a relation between the shearing stress as obtained in the simple shear test and the shear plastic strain εspf when the specimen ruptures, a conversion factor κ is used to determine the equivalent plastic strain εeq in the above-described method.

Next, the standard deviation of nano hardness was measured. The specimen for the metal microstructure observation was polished again. The specimen was measured in measurement areas of 25 μm×25 μm each at an interval of 5 μm at a ¼ depth position (¼t portion) of sheet thickness t from a steel sheet surface in a cross section in parallel to the rolling direction under a load of 1 mN (loading 10 s and unloading 10 s). From the results, an average nano hardness value and a standard deviation of nano hardness were calculated. The nano hardness was measured with the use of TriboScope/Tribolndenter available from Hysitron.

The measurement results are also shown in Table 3.

As can be clearly seen from Table 3, according to the hot rolled steel sheet according to the present invention, a hot-rolled steel sheet exhibits balanced properties, which has a tensile strength (TS) of 780 MPa or more, a product (TS×u-EL) of a uniform elongation u-EL and the tensile strength TS being equal to 9500 MPa·% or more. Further, the hot rolled steel sheet according to the present invention has an equivalent plastic strain of 0.50 or more, and it has been confirmed that the steel sheet can endure in high strain range working such as sheet metal forging.

INDUSTRIAL APPLICABILITY

According to the present invention, a hot rolled steel sheet with excellent sheet forgeability, which maintains basic features for a TRIP steel such as deep drawing workability and bulging workability, can be provided. Accordingly, the hot rolled steel sheet according to the present invention can find broad application in machine parts and the like. In particular, when it is applied to working on steel sheets including working in a high strain range such as sheet metal forging, remarkable effects thereof can be achieved.

REFERENCE SIGNS LIST

1 shear deformation generation portion

2 chucking portions

The invention claimed is:

1. A hot rolled steel sheet having a chemical composition consisting of, in mass %, C: 0.07 to 0.22%, Si: 1.00 to 3.20%, Mn: 0.80 to 2.20%, Al: 0.010 to 1.000%, N: 0.0060% or less, P: 0.050% or less, S: 0.005% or less, Ti: 0 to 0.150%, Nb: 0 to 0.100%, V: 0 to 0.300%, Cu: 0 to 2.00%, Ni: 0 to 2.00%, Cr: 0 to 2.00%, Mo: 0 to 1.00%, B: 0 to 0.0100%, Mg: 0 to 0.0100%, Ca: 0 to 0.0100%, REM: 0 to 0.1000%, Zr: 0 to 1.000%, Co: 0 to 1.000%, Zn: 0 to 1.000%, W: 0 to 1.000%, Sn: 0 to 0.050%, and the balance: Fe and impurities, wherein when a width and a thickness of the steel sheet in a cross section perpendicular to a rolling direction of the steel sheet are defined as W and t, respectively, a metal microstructure includes, in area %, at a position ¼W or ¾W from an end face of the steel sheet and ¼t or ¾t from a surface of the steel sheet, retained austenite: more than 2% to 10% or less, martensite: 2% or less, bainite: 10 to 70%, pearlite: 2% or less, the balance: ferrite an average circle-equivalent diameter of a metallic phase consisting of retained austenite and/or martensite is 1.0 to 5.0 μm, an average of minimum distances between adjacent metallic phases is 3 μm or more, a standard deviation of nano hardness is 2.5 GPa or less, the hot rolled steel sheet has an equivalent plastic strain of 0.50 or more.

2. The hot rolled steel sheet according to claim 1, wherein a tensile strength is 780 MPa or more, and a sheet thickness is 1.0 to 4.0 mm.

3. The hot rolled steel sheet according to claim 1, wherein the chemical composition contains, in mass percent, Si: 1.60 to 3.20%.

4. The hot rolled steel sheet according to claim 2, wherein the chemical composition contains, in mass percent, Si: 1.60 to 3.20%.

* * * * *